US009783968B2

(12) United States Patent
Childs et al.

(10) Patent No.: US 9,783,968 B2
(45) **Date of Patent: *Oct. 10, 2017**

(54) SINK AND DRAIN FOR SINK

(71) Applicant: Elkay Manufacturing Company, Oak Brook, IL (US)

(72) Inventors: Daniel Keating Childs, Chicago, IL (US); Shawn Daly, Shorewood, IL (US); Jonathan Chee Yeen Chong, Chicago, IL (US)

(73) Assignee: Elkay Manaufacturing Company, Oak Brook, IL (US)

( * ) Notice: Subject to any disclaimer, the term of this patent is extended or adjusted under 35 U.S.C. 154(b) by 70 days.

This patent is subject to a terminal disclaimer.

(21) Appl. No.: 14/708,883

(22) Filed: May 11, 2015

(65) Prior Publication Data

US 2015/0247308 A1 Sep. 3, 2015

Related U.S. Application Data

(63) Continuation of application No. 13/428,625, filed on Mar. 23, 2012, now Pat. No. 9,057,185.

(60) Provisional application No. 61/467,858, filed on Mar. 25, 2011, provisional application No. 61/490,138, filed on May 26, 2011.

(51) Int. Cl.

| | |
|---|---|
| ***A47K 1/04*** | (2006.01) |
| ***A47K 1/14*** | (2006.01) |
| ***E03C 1/26*** | (2006.01) |
| ***E03C 1/182*** | (2006.01) |
| ***E03C 1/23*** | (2006.01) |
| ***E03C 1/262*** | (2006.01) |
| ***E03C 1/264*** | (2006.01) |

(52) U.S. Cl.

CPC ..... *E03C 1/182* (2013.01); *E03C 1/2306* (2013.01); *E03C 1/262* (2013.01); *E03C 1/264* (2013.01); *Y10T 29/49826* (2015.01)

(58) Field of Classification Search

CPC ..... E03C 1/22; E03C 1/262; A47K 1/14
USPC ..... 4/650, 287
See application file for complete search history.

(56) References Cited

U.S. PATENT DOCUMENTS

| | | | | |
|---|---|---|---|---|
| 4,150,472 | A | 4/1979 | Derain | |
| 4,232,407 | A * | 11/1980 | Williams | E03C 1/262 4/286 |
| 5,318,230 | A | 6/1994 | Ferguson et al. | |
| 5,418,983 | A | 5/1995 | Garguillo et al. | |
| 5,535,455 | A * | 7/1996 | Liu | E03C 1/26 4/286 |

(Continued)

OTHER PUBLICATIONS

Moen® Stainless Steel Winks, Various Models, Excerpt from Catalog (1986).

(Continued)

*Primary Examiner* — Christine Skubinna
(74) *Attorney, Agent, or Firm* — Leydig, Voit & Mayer, Ltd.

(57) ABSTRACT

Sinks and drains for sinks permitting the attachment of the drain to the sink such that the drain is substantially disposed below the top surface of the sink basin, and such that there is no discernable separation between the base of the sink basin and the drain when viewed from above the sink. A method of making a sink such that there is no discernable separation between the base of the sink basin and the drain when viewed from above the sink.

8 Claims, 11 Drawing Sheets

(56) References Cited

U.S. PATENT DOCUMENTS

| | | | |
|---|---|---|---|
| 7,500,626 | B2 | 3/2009 | Berger et al. |
| 7,503,083 | B2 | 3/2009 | Ball |
| 2010/0095444 | A1 | 4/2010 | Sullivan |

OTHER PUBLICATIONS

Moen® Sani-Sink® Model 22120 Specification (Asserted to be from 1997).
Just Manufacturing Company, Excerpt from Catalog, p. 9 (Aug. 1987).
Just Manufacturing Company, Excerpt from Catalog, p. 13 (Aug. 1988).

* cited by examiner

SINK AND DRAIN FOR SINK

CROSS-REFERENCE TO RELATED APPLICATIONS

This patent application claims the benefit of U.S. Provisional Patent Application Nos. 61/467,858, filed Mar. 25, 2011, and 61/490,138, filed May 26, 2011, which are incorporated by reference in their entireties herein. This patent application is also a continuation of co-pending U.S. patent application Ser. No. 13/428,625, filed Mar. 23, 2012, which is incorporated by reference in its entirety herein.

BACKGROUND

Sinks have drains for permitting water to drain from the sink into a plumbing system. During installation, drains are typically inserted into the interior of the sink basin and dropped into an opening at the base of the basin. The drain has a rim with a diameter exceeding the diameter of the opening such that the rim rests on the top surface of the base of the sink basin. Often, the portion of the base surrounding the opening has a countersink portion such that the rim of the drain is generally flush with the adjacent portion of the base of the sink. Nonetheless, a groove is present between the rim of the drain and the sink base that is difficult to clean and susceptible to bacterial growth. In addition, the presence of the groove is visible to a user and aesthetically unappealing.

BRIEF SUMMARY

Embodiments of sinks and drains for sinks are disclosed herein. The embodiments permit the attachment of a drain to a sink such that the drain is substantially disposed below the top surface of the sink basin, and such that there is no discernable separation between the base of the sink basin and the drain when viewed from above the sink. A method of making a sink is also disclosed wherein there is no discernable separation between the base of the sink basin and the drain when viewed from above the sink.

A sink is described comprising a sink basin, a drain entry portion, a flange plate, a strainer, a first seal, and a second seal. The sink basin can have a sidewall and a base. The base can have an opening. The drain entry portion can be disposed at the opening and attached to the base. The drain entry portion can extend away from the base. The drain entry portion can have a lip for receiving the first seal. The flange plate can have an inner edge portion and an outer edge portion. The outer edge portion can be in contact with the first seal. The first seal can be disposed between the lip and the outer edge portion. The strainer can be disposed near the inner edge portion. The second seal can be disposed between the strainer and the inner edge portion.

A drain is also disclosed comprising a first seal, a drain entry portion, a flange plate, a strainer, and a second seal. The drain entry portion can have a lip for receiving the first seal. The flange plate can have an inner edge portion and an outer edge portion. The outer edge portion can be in contact with the first seal. The first seal can be disposed between the lip and the outer edge portion. The strainer can be disposed near the inner edge portion. The second seal can be disposed between the strainer and the inner edge portion.

A method of making a sink is also described. The method comprises forming a sink basin having a sidewall and a base, providing a drain entry portion, welding the drain entry portion to the base at the opening, and grinding the weld at the opening such that the drain entry portion appears integrally formed with the base when viewing into the sink basin. The base can have an opening. The drain entry portion can be cylindrical.

DETAILED DESCRIPTION

Figure 1:
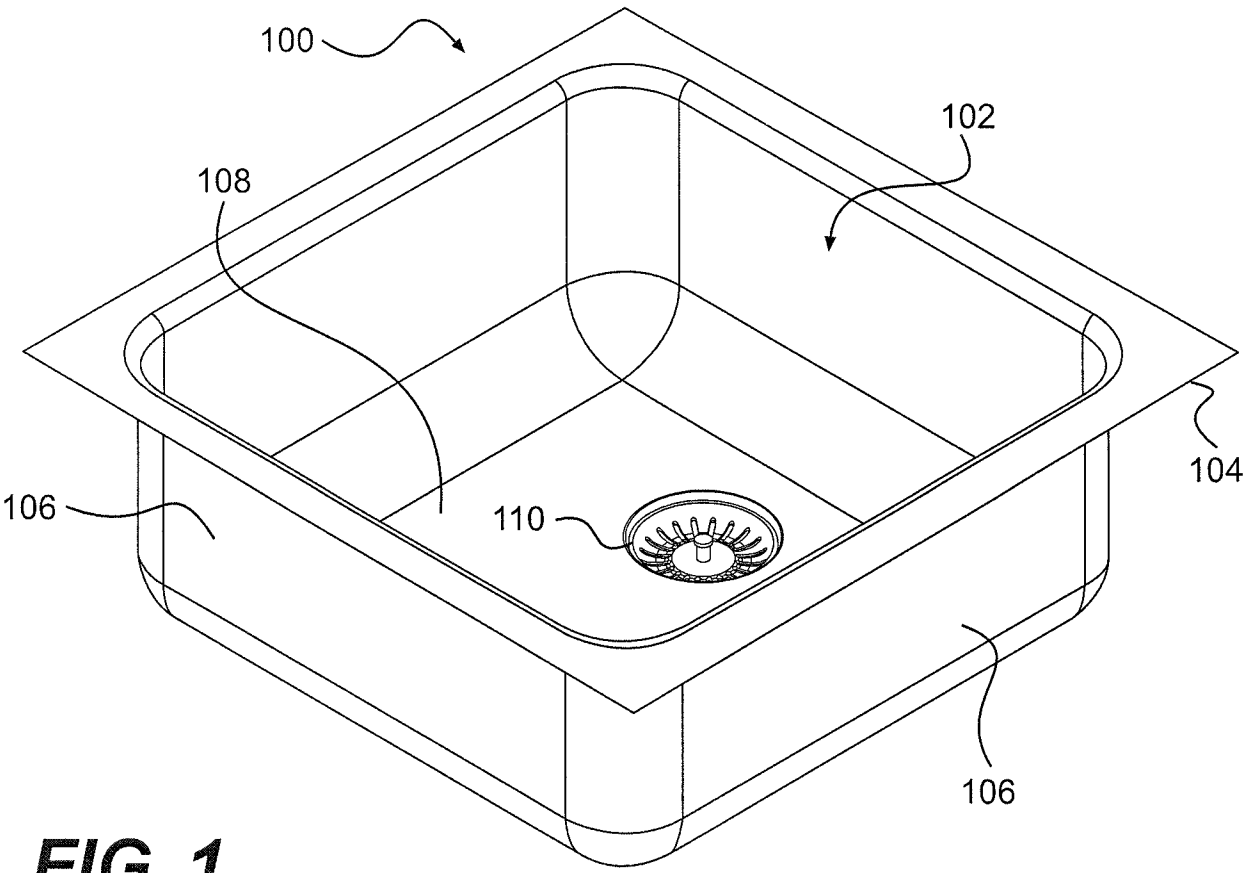
FIG. 1 is a perspective view of a sink.

Referring to FIG. 1, a sink 100 with the appearance of an edgeless drain is shown. The sink 100 can include one or more sink basins 102 and a rim 104. The sink basin 102 can include one or more sidewalls 106 and a base 108. The base 108 can include an opening 110 for a drain. The sidewalls 106 and base 108 can form an interior surface of the basin 102 to retain water and washable items. The rim 104 can be used to support the basin 102 in an above-mount arrangement or under-mount arrangement with respect to a counter. The sink 100 can be made of any suitable material, such as stainless steel.

Figure 2:
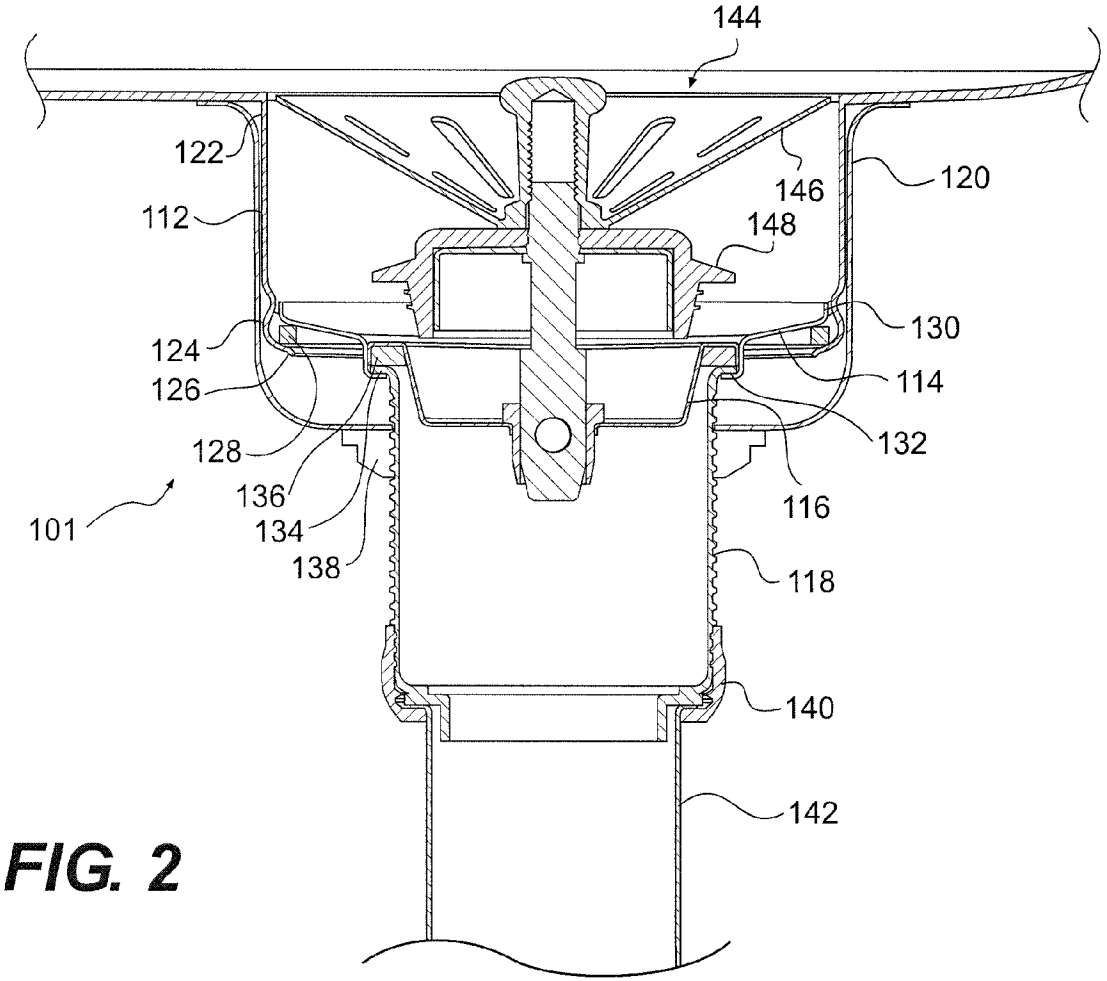
FIG. 2 is a sectional view of a drain for the sink of FIG. 1.

Referring to FIG. 2, a drain 101 is shown that can include a drain entry portion 112, a flange plate 114, a strainer 116, a drain pipe 118, and a cover 120. The drain entry portion 112 can be cylindrical and can extend from the bottom of the sink basin at the opening for the drain 101. The drain entry portion 112 can include a first end portion 122 and a second end portion 124. In some embodiments, the drain entry portion 112 can be formed as part of the sink 100. In other embodiments, the drain entry portion 112 can be a component separately manufactured from the sink 100. The first end portion 122 of the drain entry portion 112 can be welded to the base of the sink to fix the drain entry portion 112 to the sink basin at the opening. In order to conceal the welded intersection between the drain entry portion 112 and the base, a grinding and polishing operation can be applied such that the intersection is hidden to a user looking into the sink basin. In addition, because the drain entry portion 112 can be mounted from below without the need for a drain rim to rest on the base, there is no groove between the drain 101 and the sink basin 102. From a user's perspective, the drain opening leads directly into the drain 101. The weld between the sink basin and the drain entry portion 112 can be accomplished in any suitable manner, such as with a shielding gas weld.

Figure 9:
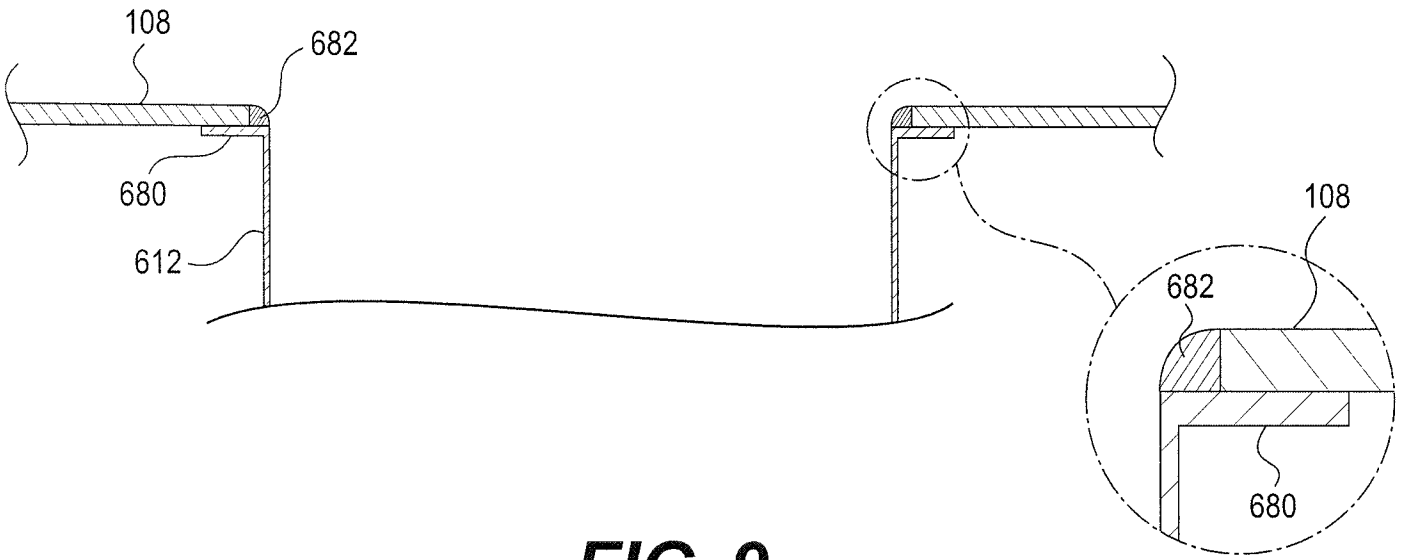
FIG. 9 is a sectional view of a drain entry portion welded to a sink.
Figure 10:
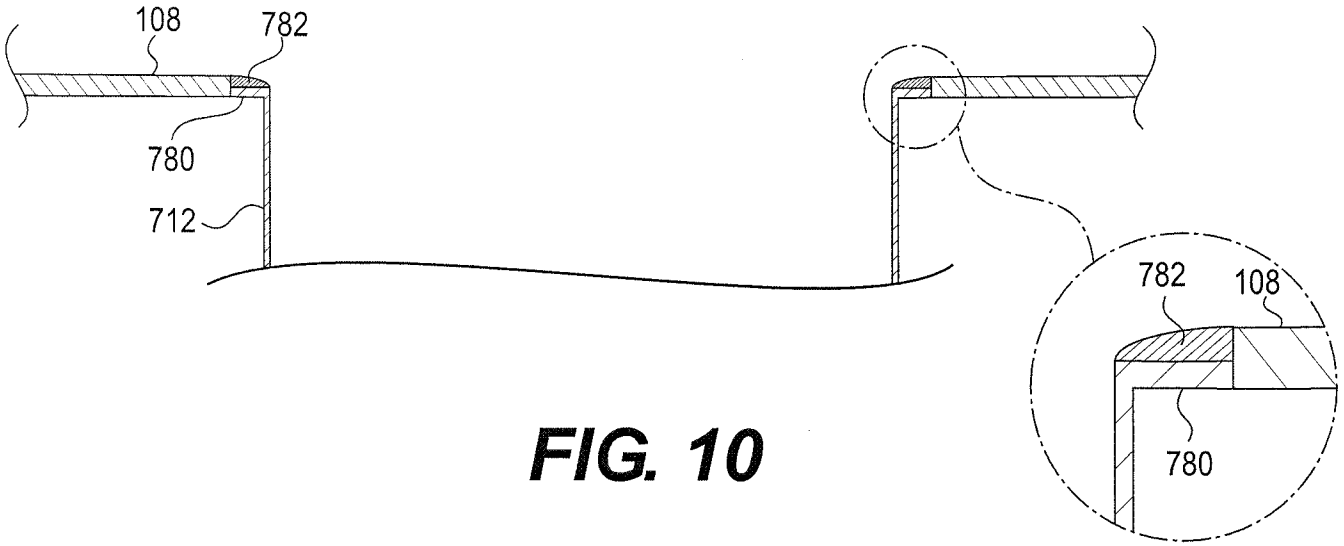
FIG. 10 is a sectional view of another embodiment of a drain entry portion welded to a sink.
Figure 11:
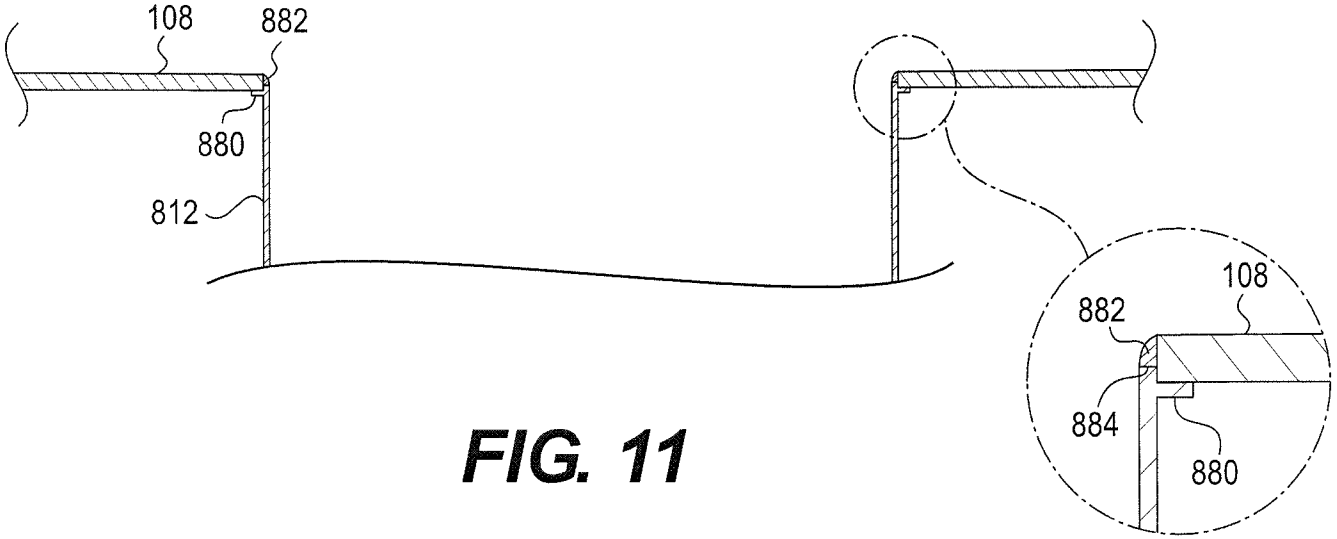
FIG. 11 is a sectional view of a further embodiment of a drain entry portion welded to a sink.

FIGS. 9-11 show examples of suitable embodiments of a drain entry portion welded to a base of a sink. It will be appreciated, however, that the drain entry portion can be coupled to the sink via any suitable manner.

Referring to FIG. 9, the drain entry portion 612 can include a radially extending flange 680. The flange 680 can be disposed against the underside of the sink base 108. The drain entry portion 612 can have an interior diameter that is smaller than the opening 110 of the sink 100 such that there is a portion of the flange 680 extending inward from the opening 110 that can receive a solder material 682 for welding the drain entry portion 612 to the sink 100. As discussed, after welding, a grinding and polishing operation can be applied to the weld such that the intersection between the drain entry portion 612 and the sink 100 is hidden to a user looking into the sink basin 102.

Turning to FIG. 10, the drain entry portion 712 can include a radially extending flange 780. The flange 780 can be disposed within the opening 110 such that the flange abuts the portion of the sink base 108 forming the opening 110. Thus, the perimeter of the flange 780 has a diameter that is smaller than the opening 110 of the sink 100 such that the flange 780 fits within the opening 110. The thickness of the flange 780 can be smaller than the thickness of the sink base 108 such that a space is formed on the upper surface of the flange 780 for receiving a solder material 782 for welding the drain entry portion 712 to the sink 100. As discussed, after welding, a grinding and polishing operation can be applied to the weld such that the intersection between the drain entry portion 612 and the sink 100 is hidden to a user looking into the sink basin 102.

As shown in FIG. 11, the drain entry portion 812 can include a radially extending flange 880. The flange 880 can be disposed away from the edge 884 of the drain entry portion 812 on the first end portion 822. The flange 880 can be disposed against the underside of the sink base 108, and the edge 884 of the drain entry portion 812 can have an exterior diameter that is smaller than the opening 110 of the sink 100. The flange 880 can be located on the drain entry portion 812 a sufficient distance from the edge such that the edge is disposed below the upper surface of the sink base 102 and such that the edge 884 can receive a solder material 882 for welding the drain entry portion 812 to the sink 100. As discussed, after welding, a grinding and polishing operation can be applied to the weld such that the intersection between the drain entry portion 812 and the sink 100 is hidden to a user looking into the sink basin 102.

Referring again to FIG. 2, the second end portion 124 of the drain entry portion 112 can include a lip 126 for receiving a seal 128. The flange plate 114 can have an outer edge portion 130 and an inner edge portion 132. The outer edge portion 130 of the flange plate 114 can rest on the seal 128 such that the seal 128 prevents water inside the drain 101 from passing between the intersection of the drain entry portion 112 and the flange plate 114. The inner edge portion 132 of the flange plate 114 can receive a lip 134 of the drain pipe 118 for supporting the drain pipe 118.

The strainer 116 can be disposed above the lip 134 of the drain pipe 118 and the inner edge portion 132 of the flange plate 114. The strainer 116 can include a seal 136 for contacting the lip 134 of the drain pipe 118 and preventing the passage of water in the drain 101 past the seal 136. The strainer 116 can be press fit within the flange plate 114. The strainer 116 can have one or more openings in the bottom of the strainer to permit water to flow past the strainer 116 and into the drain pipe 118.

The drain 101 can include a cover 120 over the drain entry portion 112, the flange plate 114, and the strainer 116. The cover 120 can be secured to the sink with a locking nut 138. The drain pipe 118 can be threaded to receive the locking nut 138, and the locking nut 138 can be tightened to enhance the seal force applied between the drain entry portion 112 and the flange plate 114. A coupler 140 can be used to attach the drain pipe 118 to a pipe 142 leading to a trap.

A removeable strainer basket 144 can be disposed within the drain 101. The strainer basket 144 can include a basket portion 146 for capturing solids and a stopper 148 that can be lowered into the strainer 114 to plug the drain 101.

Figure 3:
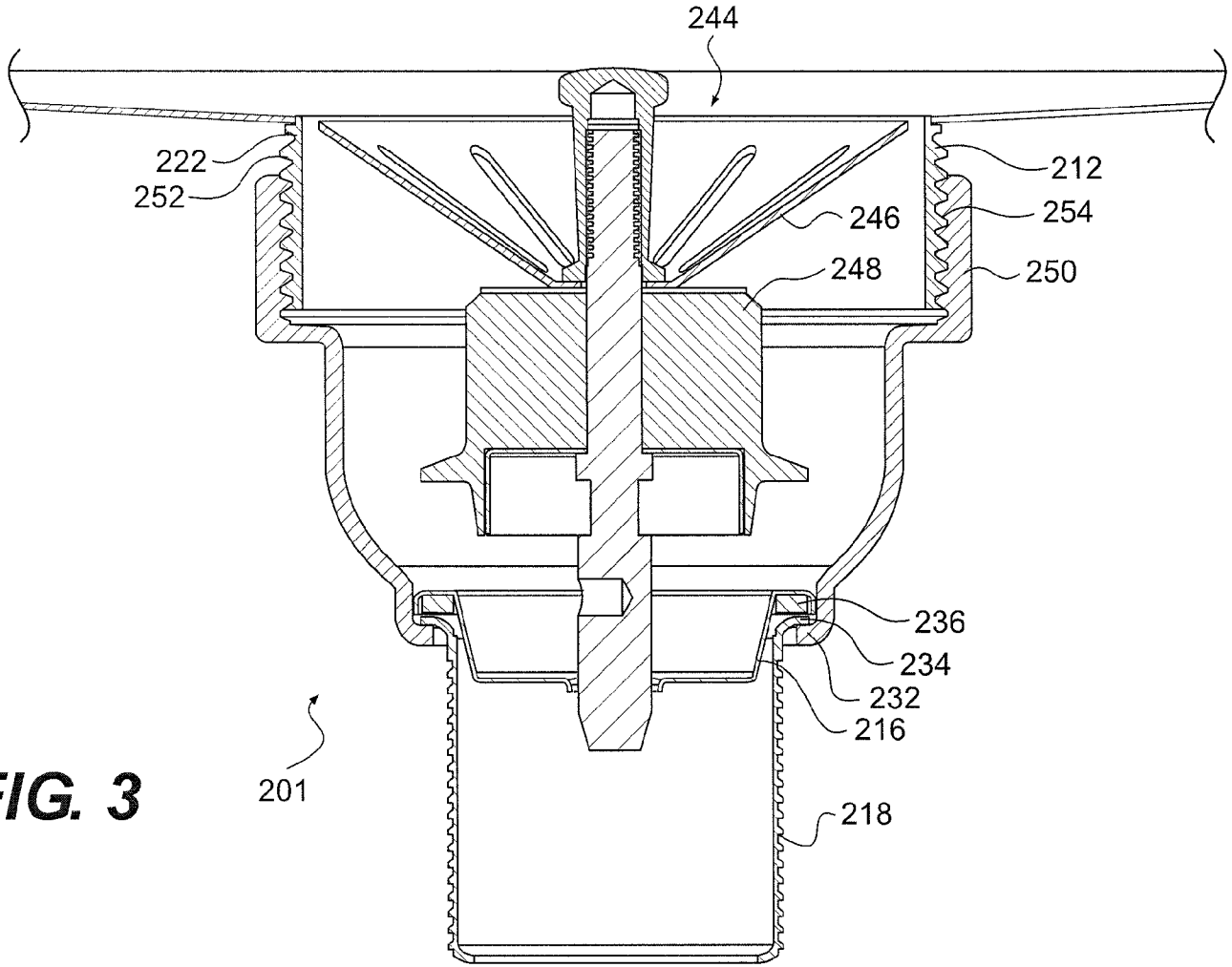
FIG. 3 is a sectional view of a second embodiment of a drain for the sink of FIG. 1.

Turning to FIG. 3, a second embodiment of a drain 201 is shown that can include a drain entry portion 212, an attachment portion 250, a strainer 216, and a drain pipe 218. The drain entry portion 212 can be cylindrical and can extend from the bottom of the sink basin at the opening for the drain 201. The drain entry portion 212 can include a first end portion 222 and a threaded exterior surface 252. The drain entry portion 212 can be a component separately manufactured from the sink. The first end portion 222 of the drain entry portion 212 can be welded to the base to fix the drain entry portion 212 to the sink basin at the opening. In order to conceal the welded intersection between the drain entry portion 212 and the base, a grinding and polishing operation can be applied such that the intersection is hidden to a user looking into the sink basin. In addition, because the drain entry portion 212 can be mounted from below without the need for a drain rim to rest on the base, there is no groove between the drain 201 and the sink basin. From a user's perspective, the drain opening leads directly into the drain 201. The weld between the sink basin and the drain entry portion 212 can be accomplished in any suitable manner, such as with a shielding gas weld.

The attachment portion 250 can have a threaded surface 254 and an inner edge portion 232. The attachment portion threaded surface 254 can be received and tightened to the threaded surface 252 of the drain entry portion 212. The inner edge portion 232 of the attachment portion 250 can receive a lip 234 of the drain pipe 218 for supporting the drain pipe 218.

The strainer 216 can be disposed above the lip 234 of the drain pipe 218 and the inner edge portion 232 of the attachment portion 250. The strainer 216 can include a seal 236 for contacting the lip 234 of the drain pipe 218 and preventing the passage of water in the drain 201 past the seal 236. The strainer 216 can be press fit within the attachment portion 250. The strainer 216 can have one or more openings in the bottom of the strainer to permit water to flow past the strainer 216 and into the drain pipe 218. The drain pipe 218 can be threaded to receive a coupler that can be used to attach the drain pipe to a pipe leading to a trap.

A removeable strainer basket 244 can be disposed within the drain 201. The strainer basket 244 can include a basket portion 246 for capturing solids and a stopper 248 that can be lowered into the strainer 216 to plug the drain 201.

Figure 4:
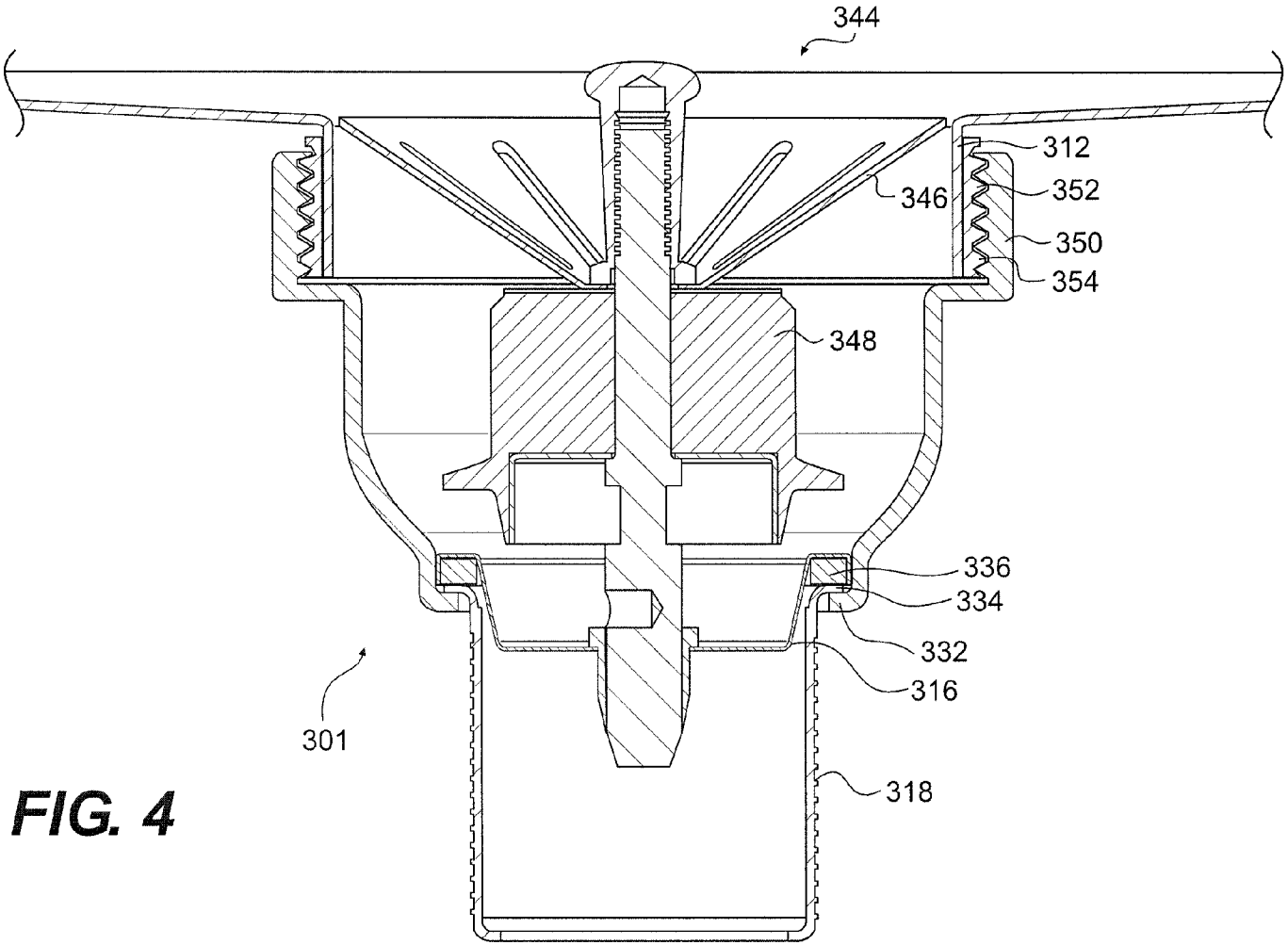
FIG. 4 is a sectional view of a third embodiment of a drain for the sink of FIG. 1.

Referring to FIG. 4, a third embodiment of a drain 301 is shown that can include a drain entry portion 312, an attachment portion 350, a strainer 316, and a drain pipe 318. The drain entry portion 312 can be cylindrical and can extend from the bottom of the sink basin at the opening for the drain 301. In this embodiment, the drain entry portion 312 can be formed from the sink basin during the drawing process to shape the sink. Thus, the drain entry portion 312 can be integrally formed to lead directly from the sink basin to the drain 301. Threads 352 can be welded or otherwise attached to the drain entry portion 312.

The attachment portion 350 can have a threaded surface 354 and an inner edge portion 332. The attachment portion threaded surface 354 can be received and tightened to the threads 352 of the drain entry portion 312. The inner edge portion 332 of the attachment portion 350 can receive a lip 334 of the drain pipe 318 for supporting the drain pipe 318.

The strainer 316 can be disposed above the lip 334 of the drain pipe 318 and the inner edge portion 332 of the attachment portion 350. The strainer 316 can include a seal 336 for contacting the lip 334 of the drain pipe 318 and preventing the passage of water in the drain 301 past the seal. The strainer 316 can be press fit within the attachment portion 350. The strainer 316 can have one or more openings in the bottom of the strainer to permit water to flow past the strainer 316 and into the drain pipe 318. The drain pipe 318 can be threaded to receive a coupler that can be used to attach the drain pipe to a pipe leading to a trap.

A removeable strainer basket 344 can be disposed within the drain 301. The strainer basket 301 can include a basket portion 346 for capturing solids and a stopper 348 that can be lowered into the strainer 316 to plug the drain 301.

Figure 5:
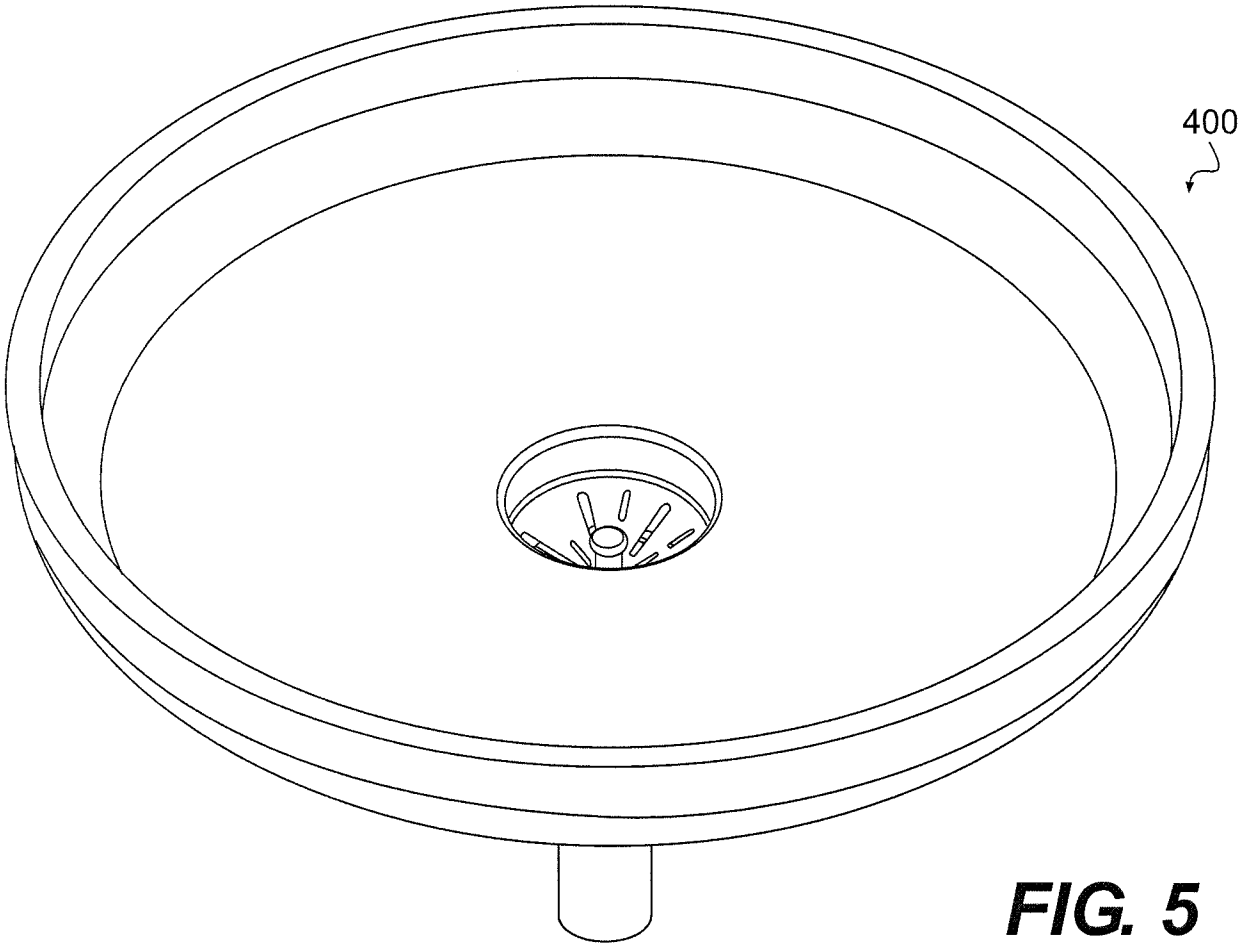
FIG. 5 is a perspective view of another embodiment of a sink.
Figure 6:
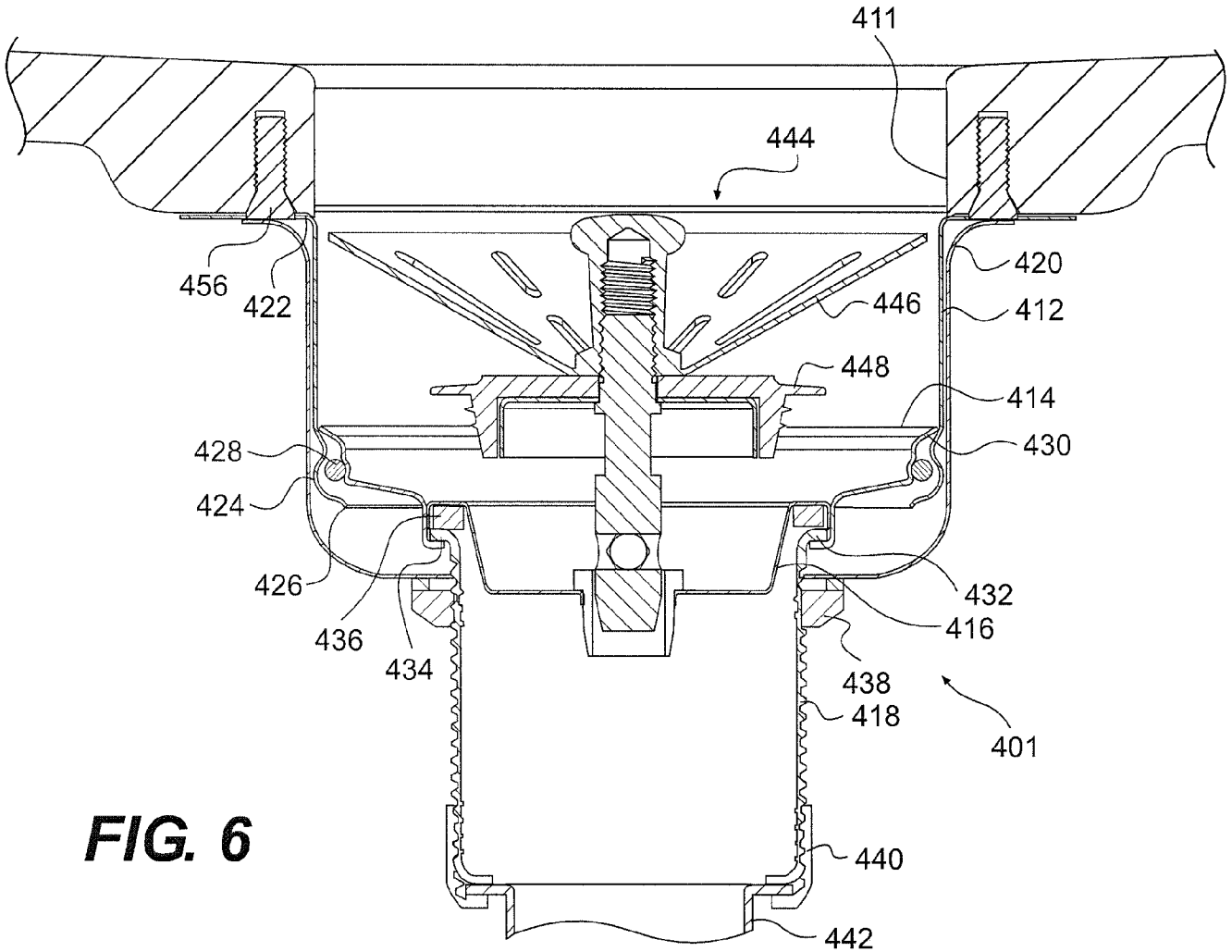
FIG. 6 is a sectional view of an embodiment of a drain for the sink of FIG. 5.

FIGS. 5 and 6 show another embodiment of an edgeless drain 401 suitable for use with a non-metallic sink 400, such as a sink made of granite or other suitable stone. The drain 401 can include a first drain entry portion 411, a second drain entry portion 412, a flange plate 414, a strainer 416, a drain pipe 418, and a cover 420. The first drain entry portion 411 can be cylindrical and can extend from the bottom of the sink basin at the opening for the drain 401. Similar to the embodiment of FIG. 4, the first drain entry portion 411 can be formed as part of the sink basin during the process of making the sink. Thus, the first drain entry portion 411 leads directly from the sink basin into the drain 401.

The second drain entry portion 412 can include a first end portion 422 and a second end portion 424. The second drain entry portion 412 can be a component separately manufactured from the sink. The first end portion 422 of the second drain entry portion 412 can include one or more apertures such that the drain entry portion 412 can be fastened to the bottom of the sink using suitable fasteners 456 disposed through the apertures, such as one or more screws.

The second end portion 424 of the second drain entry portion 412 can include a lip 426 for receiving a seal 428. The flange plate 414 can have an outer edge portion 430 and an inner edge portion 432. The outer edge portion 430 of the flange plate 414 can rest on the seal 428 such that the seal 428 prevents water inside the drain 401 from passing between the intersection of the second drain entry portion 412 and the flange plate 414. The inner edge portion 432 of the flange plate 414 can receive a lip 434 of the drain pipe 418 for supporting the drain pipe 418.

The strainer 416 can be disposed above the lip 434 of the drain pipe 418 and the inner edge portion 432 of the flange plate 414. The strainer 416 can include a seal 436 for contacting the lip 434 of the drain pipe 418 and preventing the passage of water in the drain 401 past the seal 436. The strainer 416 can be press fit within the flange plate 414. The strainer 416 can have one or more openings in the bottom of the strainer to permit water to flow past the strainer 416 and into the drain pipe 418.

The drain 401 can include a cover 420 over the second drain entry portion 412, the flange plate 414, and the strainer 416. The cover 420 can be secured to the sink with a locking nut 438. The drain pipe 418 can be threaded to receive the locking nut 438, and the locking nut 438 can be tightened to enhance the seal force applied between the second drain entry portion 412 and the flange plate 414. A coupler 440 can be used to attach the drain pipe 418 to a pipe 442 leading to a trap.

A removeable strainer basket 444 can be disposed within the drain 401. The strainer basket 444 can include a basket portion 446 for capturing solids and a stopper 448 that can be lowered into the strainer 416 to plug the drain 401.

Figure 7:
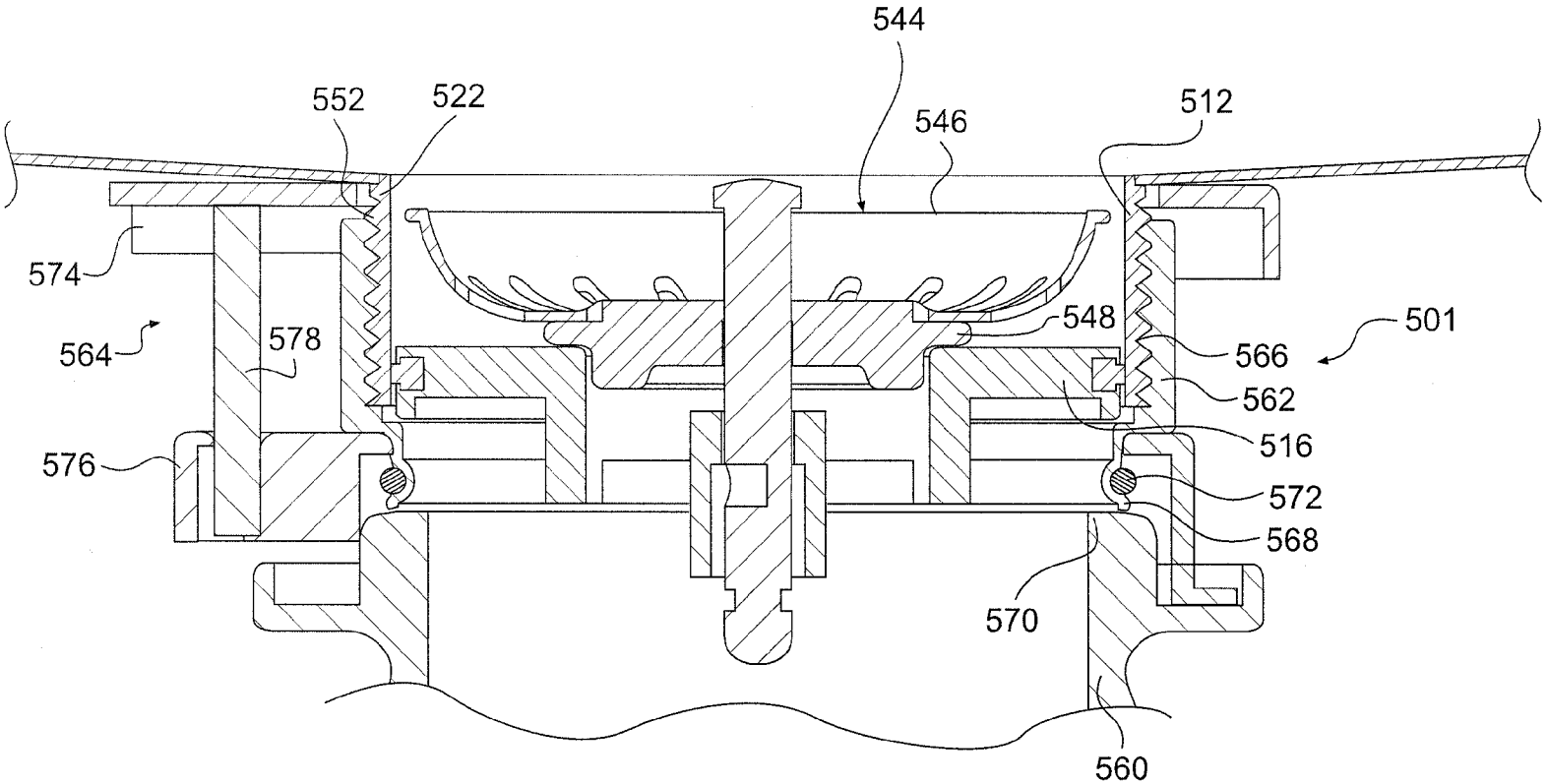
FIG. 7 is a sectional view of an embodiment of a drain for a sink attached to a garbage disposer.
Figure 8:
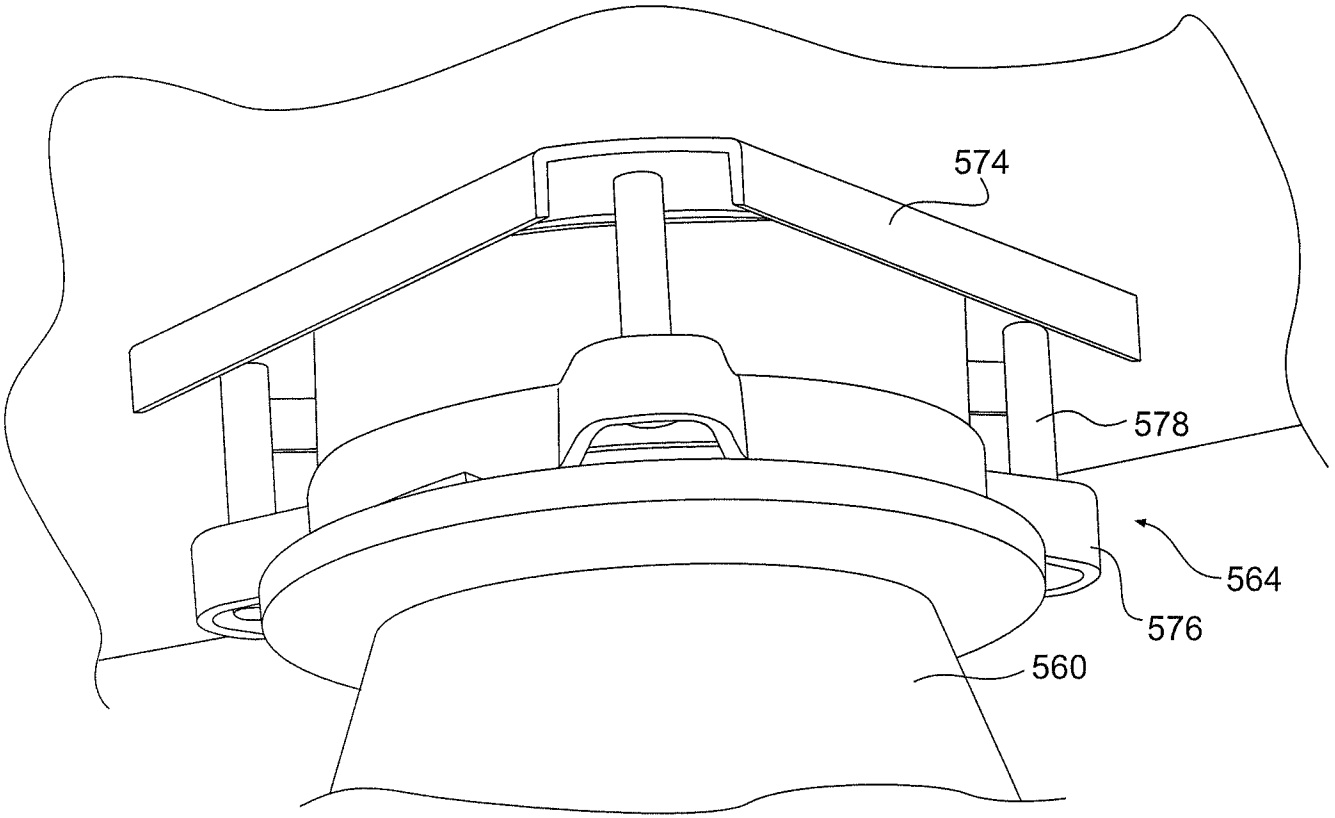
FIG. 8 is a fragmentary bottom perspective view showing the drain of FIG. 7.

It will be appreciated that the above-described sink and drain embodiments may be utilized with a garbage disposer. For example, FIGS. 7 and 8 show an embodiment of a drain 501 attached to a garbage disposer 560. In this embodiment, the drain 501 can include a drain entry portion 512, a disposer attachment ring 562, a strainer 516, and a disposer assembly 564. The drain entry portion 512 can be cylindrical and can extend from the bottom of the sink basin at the opening for the drain 501. The drain entry portion 512 can include a first end portion 522 and a threaded exterior surface 552. The drain entry portion 512 can be a component separately manufactured from the sink. The first end portion 522 of the drain entry portion 512 can be welded to the base to fix the drain entry portion 512 to the sink basin at the opening. In order to conceal the welded intersection between the drain entry portion 512 and the base, a grinding and polishing operation can be applied such that the intersection is hidden to a user looking into the sink basin. In addition, because the drain entry portion 512 can be mounted from below without the need for a drain rim to rest on the base, there is no groove between the drain 501 and the sink basin. From a user's perspective, the drain opening leads directly into the drain 501. The weld between the sink basin and the drain entry portion 512 can be accomplished in any suitable manner, such as with a shielding gas weld.

The disposer attachment ring 562 can have a threaded surface 566 and a lower portion 568. The flange plate threaded surface 552 can be received and tightened to the threaded exterior surface 566 of the drain entry portion 512. The lower portion 568 can have a detent 570 for receiving a snap ring 572. The strainer 516 can be disposed above detent 570. The strainer 516 can have one or more openings in the bottom of the strainer to permit water to flow past the strainer 516 and into the disposer 560.

The disposer assembly 564 can include a backup flange 574 and a mounting ring 576. The backup flange 574 can be generally triangular and the mounting ring 576 can have a plurality of tightening screws 578 for contacting the backup flange 574 near each vertex of the backup flange 574. During tightening of the screws 578, the mounting ring 576 can be retained to the disposer attachment ring 562 by the snap ring 572. As is known to those of skill in the art, the disposer 560 can include a bracket for hanging the disposer from the mounting ring.

A removeable strainer basket 544 can be disposed within the drain 501. The strainer basket 544 can include a basket portion 546 for capturing solids and a stopper 548 that can be lowered into the strainer 516 to plug the drain 501.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sink comprising:

a sink basin having a sidewall and a base, the base having an opening;

a drain entry portion disposed at the opening and being welded to the base at the opening, the weld being smooth to appear integrally formed with the base when viewing into the sink basin, the drain entry portion including a cylindrical wall extending away from the base;

a flange plate having an inner edge portion and an outer edge portion, the inner edge portion forming a drain opening that permits water from the drain entry portion to flow through the flange plate, the outer edge portion and the cylindrical wall of the drain entry portion intersecting so as to prevent passage of water therebetween;

a drain pipe intersecting with the inner edge portion of the flange plate to prevent the passage of water therebetween;

a strainer disposed in the drain pipe; and a removable drain basket that includes a stopper, the stopper being selectively placeable between a lowered position, in which the stopper covers the strainer to plug the drain opening, and a raised position, in which water from the drain entry portion flows around the stopper and through the drain opening.

2. The sink of claim 1, wherein the drain entry portion does not extend above the base through the opening.

3. A method of making a sink comprising:

forming a sink basin having a sidewall and a base, the base having an opening;

providing a drain entry portion, the drain entry portion being cylindrical and having a cylindrical wall;

welding the drain entry portion to the base at the opening;

grinding the weld at the opening such that the drain entry portion appears integrally formed with the base when viewing into the sink basin;

providing a flange plate having an inner edge portion and an outer edge portion, the inner edge portion forming a drain opening that permits water from the drain entry portion to flow through the flange plate, the outer edge portion and the cylindrical wall of the drain entry portion intersecting so as to prevent passage of water therebetween;

providing a drain pipe, the drain pipe intersecting the inner edge portion of the flange plate to prevent passage of water therebetween;

covering the drain opening with a strainer that is connected to one of the drain pipe and the flange plate; and mounting a removable drain basket that includes a stopper to the strainer, the stopper being selectively placeable between a lowered position, in which the stopper covers the strainer to plug the drain opening, and a raised position, in which water from the drain entry portion flows around the stopper and through the drain opening and the strainer.

4. The method of claim 3, wherein welding the drain entry portion to the base includes creating a weld bead that extends peripherally around the opening.

5. The method of claim 3, wherein grinding the weld at the opening is accomplished such that the drain entry portion does not extend above the base through the opening.

6. A sink comprising:

a sink basin having a sidewall and a base, the base having an opening;

a drain entry portion disposed at the opening and being connected to the base at the opening, the connection being smooth to appear integrally formed with the base when viewing into the sink basin, the drain entry portion extending away from the base and having a cylindrical wall;

a flange plate having an inner edge portion and an outer edge portion, the inner edge portion forming a drain opening that permits water from the drain entry portion to flow through the flange plate, the outer edge portion and the cylindrical wall of the drain entry portion intersecting so as to prevent passage of water therebetween;

a drain pipe intersecting with the inner edge portion of the flange plate to prevent the passage of water therebetween;

a strainer; and a removable drain basket that includes a stopper, the stopper being selectively placeable between a lowered position, in which the stopper covers the strainer to plug the drain opening, and a raised position, in which water from the drain entry portion flows around the stopper and through the drain opening.

7. The sink of claim 6, wherein the connection of the drain entry portion to the base is a weld.

8. The sink of claim 6, wherein the drain entry portion does not extend above the base through the opening.

* * * * *